US007155856B1

(12) United States Patent
Hylenski

(10) Patent No.: US 7,155,856 B1
(45) Date of Patent: Jan. 2, 2007

(54) INTEGRAL LOCKING SYSTEM FOR RIFLE

(75) Inventor: Peter J. Hylenski, Danbury, CT (US)

(73) Assignee: Kimber IP, LLC, Yonkers, NY (US)

( * ) Notice: Subject to any disclaimer, the term of this patent is extended or adjusted under 35 U.S.C. 154(b) by 0 days.

(21) Appl. No.: 11/099,204

(22) Filed: Apr. 5, 2005

(51) Int. Cl.
*F41A 17/00* (2006.01)

(52) U.S. Cl. ..... 42/70.08; 42/70.11; 42/70.01

(58) Field of Classification Search ..... 42/16, 42/70.06, 70.11, 70.01, 70.08; 70/491
See application file for complete search history.

(56) References Cited

U.S. PATENT DOCUMENTS 1,741,390 A * 12/1929 Wise ..... 70/359
2,687,638 A * 8/1954 Abernathy ..... 70/491
3,234,679 A * 2/1966 Benson ..... 42/70.06
4,672,762 A * 6/1987 Nilsson ..... 42/70.01
5,289,653 A * 3/1994 Szebeni et al. ..... 42/70.11
5,491,918 A * 2/1996 Elmstedt ..... 42/70.11
5,544,512 A * 8/1996 Shieh ..... 70/491
5,551,180 A 9/1996 Findlay et al.
6,038,898 A * 3/2000 Cliff ..... 70/491
6,141,896 A 11/2000 Oberst
6,154,996 A 12/2000 Andreassen
6,173,518 B1 1/2001 Oberst
6,178,682 B1 * 1/2001 Zedrosser et al. ..... 42/16
6,886,285 B1 * 5/2005 Sirkis et al. ..... 42/70.08
2004/0231379 A1 * 11/2004 Yu ..... 70/491
2005/0086846 A1 * 4/2005 Beretta ..... 42/70.11
2005/0188577 A1 * 9/2005 Popikow ..... 42/16
2005/0229461 A1 * 10/2005 McGarry ..... 42/70.08

* cited by examiner

*Primary Examiner*—Michael J. Carone
*Assistant Examiner*—Benjamin P. Lee
(74) *Attorney, Agent, or Firm*—Caesar, Rivise, Bernstein, Cohen & Pokotilow, Ltd.

(57) ABSTRACT

A firearm integral locking system includes a cocking piece lock in a housing slot. The lock has a blade and a key aperture. The slot allows rotational movement. The cocking piece and lock each have an aperture. A plunger is slidably received in the cocking piece aperture. A spring urges the plunger towards the lock. The spring abuts the plunger and the cocking piece aperture. A key is insertable into the lock aperture and abuts the plunger to urge the plunger into the cocking piece. When the plunger is inserted, the lock is free to rotate. When the key is removed and the plunger is urged into the lock aperture, the lock is secured. The cocking piece has a groove to receive the blade of the lock and allows the blade and cocking piece to move rotationally. Longitudinal movement of the cocking piece is precluded when the lock is locked.

5 Claims, 6 Drawing Sheets

FIG.4
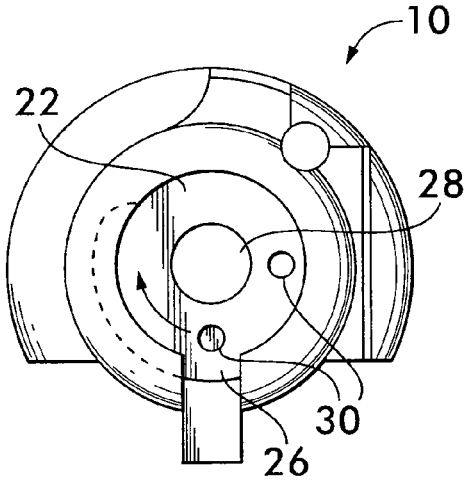
FIG.5
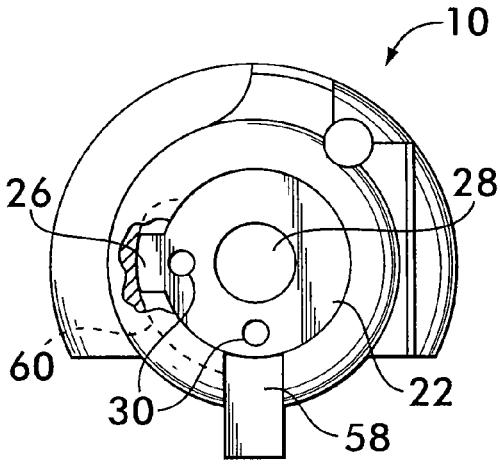
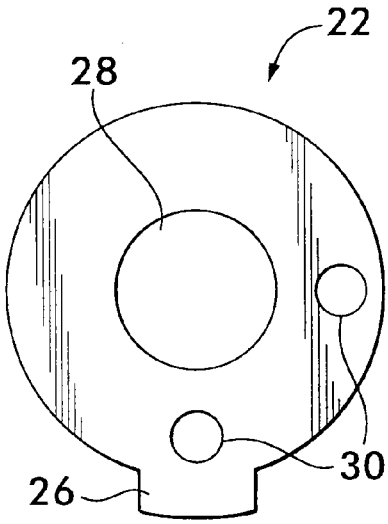
FIG.6
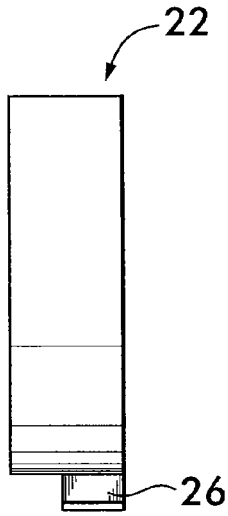
FIG.7

FIG.8
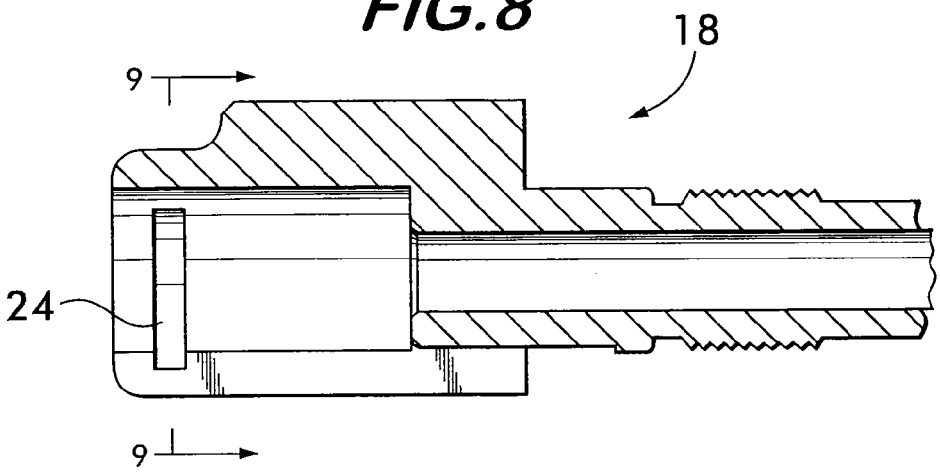
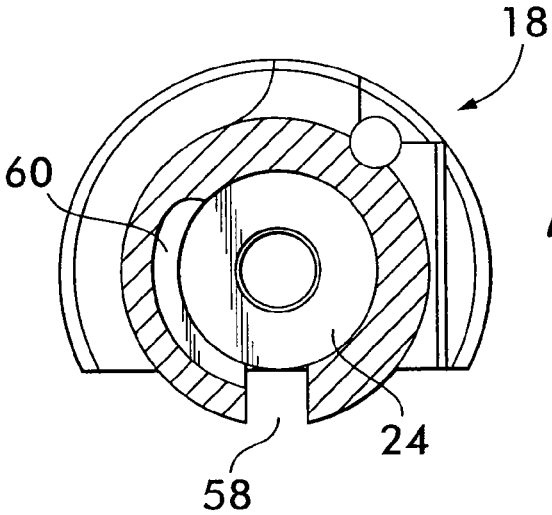
FIG.9
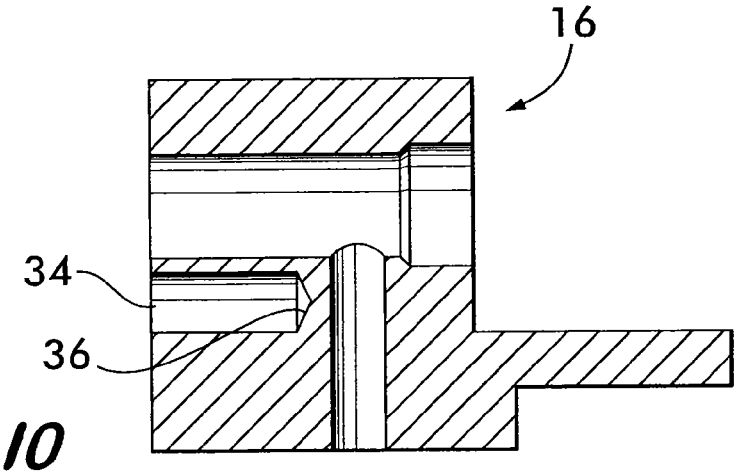
FIG.10

FIG.11
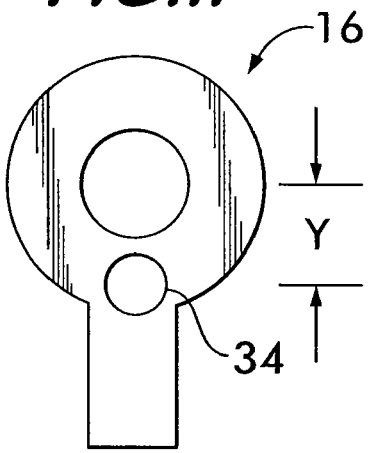
FIG.12
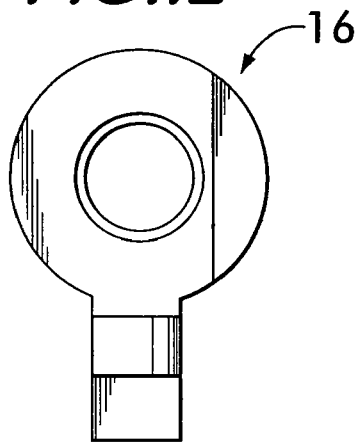
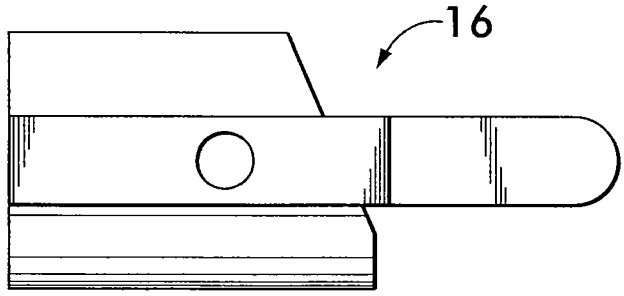
FIG.13
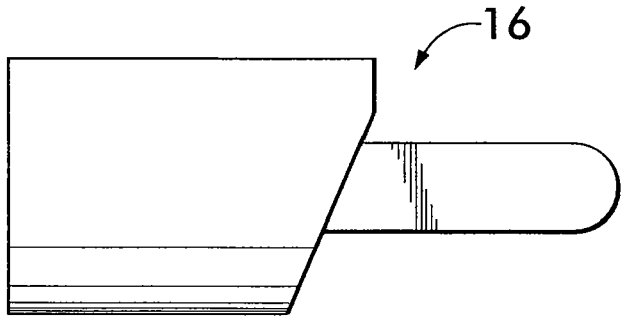
FIG.14

INTEGRAL LOCKING SYSTEM FOR RIFLE

BACKGROUND OF THE INVENTION

This invention relates to firearms in general. More particularly, this invention relates to an integral locking system for bolt-action rifles.

The Winchester Model 70 Bolt-Action Rifle has been around for many decades. Many rifle manufactures make variations of this bolt action rifle, but the basic design has remained generally unchanged. This rifle type has a "bolt-action" design wherein a person shooting the rifle loads a round by causing the rifle to move a cartridge from a loaded magazine to the chamber of the gun. In a conventional Model 70 design, to load a round, the shooter first loads the magazine by moving the rifle's three-position safety to its intermediate position (where the firing pin is locked, but the rifle's bolt is unlocked). The bolt handle is rotated counter-clockwise and, once rotated, the bolt is pulled back all the way such that a cartridge receiver is opened for accepting a cartridge. The shooter presses the cartridge down into the magazine, presses another cartridge down into the magazine, etc. until the magazine is loaded to capacity. To shoot, the bolt is pushed forward and then rotated clockwise (using its bolt handle). The safety is rotated forward to a ready to fire position. The shooter then fires the rifle. Once fired, the bolt handle is rotated up (counterclockwise) and then pulled rearward until the fired cartridge is ejected by the rifle. The bolt is then pushed forward which moves a cartridge from the magazine into the firing chamber and the bolt is then again rotated clockwise.

One feature common to Winchester Model 70 type rifles is a three-position safety. In its first position where the safety lever is rotated to its forward-most position, both the bolt and the firing pin are unlocked and the rifle is ready to fire. In its second position where the safety is in its second, intermediate, position, the bolt is unlocked, but the firing pin is in its locked position. Finally, in its third position, both the bolt and the firing pin are in locked positions.

Many designs for locks for firearms and specifically for bolt-action rifles are known. However, it would be desirable to provide an integral lock system that prevents all movement of the bolt of a bolt-action rifle when the system is locked, but that provides for quick and easy unlocking, with use of a separate, secure key to prevent the operation of a firearm by an unauthorized person.

U.S. Pat. No. 5,551,180 (Findlay et al.) discloses a releasable bolt lock for a two position safety for bolt action firearms that can be actuated separate from the safety lever and that allows for unloading of the rifle in the "safe" or on position.

All references cited herein are incorporated herein by reference in their entireties.

BRIEF SUMMARY OF THE INVENTION

In a first preferred embodiment of the present invention, an integral locking system for a firearm is provided where the firearm has a barrel having a longitudinal axis, a bolt, a cocking piece having an integral firing pin, and a cocking piece housing. The bolt is axially rotatable relative to the cocking piece housing. The integral locking system includes a cocking piece lock rotatably disposed in a receiving slot in the cocking piece housing. The lock has an integral blade extending from the lock. The cocking piece has a groove to receive the blade of the lock. The groove allows the blade of the lock and cocking piece to move rotationally relative to the cocking piece housing and stop longitudinal movement of the cocking piece when the lock is rotated to a locked position. The cocking piece may have a slot to receive the blade prior to receipt of the blade into the groove where the slot receives the blade when the cocking piece is moved forward relative to the cocking piece housing before the blade is received in the groove.

An integral locking system for a firearm is provided where the firearm has a barrel having a longitudinal axis, a bolt, a cocking piece having an integral firing pin, and a cocking piece housing. The bolt is axially rotatable relative to the cocking piece housing. The integral locking system includes a cocking piece lock where the lock is rotatably disposed in a receiving slot in the cocking piece housing. The lock has an integral blade extending from the lock and an aperture to receive a key. The slot allows rotational movement of the lock about the longitudinal axis, but substantially no movement along the longitudinal axis. The cocking piece has at least one aperture which is positioned generally parallel to the longitudinal axis and at radial distance from the longitudinal axis. The aperture does not extend through the cocking piece; it has a bottom. The cocking piece lock has at least one aperture and is positioned generally parallel to the longitudinal axis and at substantially the same radial distance as the cocking piece. A cocking piece plunger is provided that is slidably received in the aperture. The plunger has a smaller cross section than the cross section of the aperture of the cocking piece such that the entire plunger is slidably receivable in the aperture of the cocking piece. A cocking piece spring urges the plunger in a direction towards the lock. A first end of the spring abuts the plunger and a second end abuts the bottom of the aperture in the cocking piece. A key having at least one protuberance is insertable into the aperture in the lock where the protuberance has a length such that each protuberance extends through the lock and abuts the plunger to urge the plunger fully into the cocking piece towards the bottom of the aperture in the cocking piece. When the plunger is fully inserted into the aperture of the cocking piece, the lock is free to rotate relative to the cocking piece housing and when the key is removed and the plunger is urged into one of the lock apertures by the spring, the lock is held securely and is not free to move rotationally relative to the cocking piece housing. The cocking piece has a groove to receive the blade of the lock. The groove allows the blade of the lock and cocking piece to move rotationally relative to the cocking piece housing. Longitudinal movement of the cocking piece is precluded when the lock is rotated to a locked position.

The cocking piece may have a slot to receive the blade prior to receipt of the blade into the groove. The slot receives the blade when the cocking piece is moved forward relative to the cocking piece housing before the blade is received in the groove.

In another embodiment of the present invention, an integral locking system for a firearm is provided where the firearm has a barrel having a longitudinal axis, a bolt, a cocking piece having an integral firing pin, and a cocking piece housing. The bolt is axially rotatable relative to the cocking piece housing. The integral locking system includes a generally circular cocking piece lock. The lock is rotatably disposed in a receiving slot in the cocking piece housing and has an integral blade extending from the lock, a central aperture and at least one aperture adapted to receive a key. The slot is adapted to allow rotational movement of the lock about the longitudinal axis, but substantially no movement along the longitudinal axis. The cocking piece has at least one aperture therein having a cross section and positioned generally parallel to the longitudinal axis and at radial distance from the longitudinal axis. The aperture has a bottom. The cocking piece lock has at least one aperture therein that is positioned generally parallel to the longitudinal axis and at substantially the same radial distance as the aperture of the cocking piece. A cocking piece plunger is provided that has a shaft portion slidably received in the aperture of the cocking piece, an annular flange adjacent to the shaft portion, the annular flange being larger in cross-section than the shaft, and a head portion. The head portion is smaller in cross section than the annular flange. The shaft portion, the head portion, and the annular flange all having a smaller cross section than the cross section of the aperture of the cocking piece such that the entire plunger is slidably receivable in the aperture of the cocking piece. A cocking piece coil spring disposed on the plunger to urge the plunger in a direction towards the lock. The coil spring has an internal diameter larger than the shaft of the plunger, but smaller than the annular flange. The spring has a first end and a second end where the first end abuts the annular flange and the second end abuts the bottom of the aperture in the cocking piece. A key having at least one protuberance is adapted be inserted into the at least one aperture in the lock, each protuberance having a length such that each protuberance extends through the lock and abuts the head portion of the plunger to urge the head of the plunger fully into the cocking piece towards the bottom of the aperture in the cocking piece. When the plunger is fully inserted into the cocking piece, the lock is free to rotate relative to the cocking piece housing and when key is removed and the plunger is urged into one of the lock apertures, the lock is held securely and is not free to move rotationally relative to the cocking piece housing. The cocking piece has a slot and a groove adapted to receive the blade of the lock. The slot receives the blade when the cocking piece is moved forward relative to the cocking piece housing. The groove receives the blade of the lock after the blade is moved forward into the slot and allows the blade of the lock and cocking piece to move rotationally relative to the cocking piece housing and stop longitudinal movement of the cocking piece when the lock is rotated to a locked position.

BRIEF DESCRIPTION OF SEVERAL VIEWS OF THE DRAWINGS

The invention will be described in conjunction with the following drawings in which like reference numerals designate like elements and wherein:

FIG. 4 is a side left side elevation view of the bolt cocking piece and cocking piece housing of FIG. 3, depicted with the lock in an unlocked position;

FIG. 5 is a side left side elevation view of the bolt cocking piece and cocking piece housing of FIG. 3, depicted with the lock in a locked position;

FIG. 6 is a top view of the lock as used in the bolt, cocking piece, and cocking piece housing of the firearm of FIG. 1;

FIG. 7 is a side view of the lock of FIG. 6;

FIG. 8 is a front cross sectional view of the cocking piece housing, as used in the firearm of FIG. 1;

FIG. 9 is a side, cross sectional view of the cocking piece housing of FIG. 8;

FIG. 10 is a front, cross sectional view of the cocking piece, as used in the firearm of FIG. 1;

FIG. 11 is a right side view of the cocking piece of FIG. 10;

FIG. 12 is a left side view of the cocking piece of FIG. 10;

FIG. 13 is a top view of the cocking piece of FIG. 10;

FIG. 14 is a bottom view of the cocking piece of FIG. 10;

DETAILED DESCRIPTION OF THE INVENTION

The invention will be illustrated in more detail with reference to the following embodiments, but it should be understood that the present invention is not deemed to be limited thereto.

Figure 1:
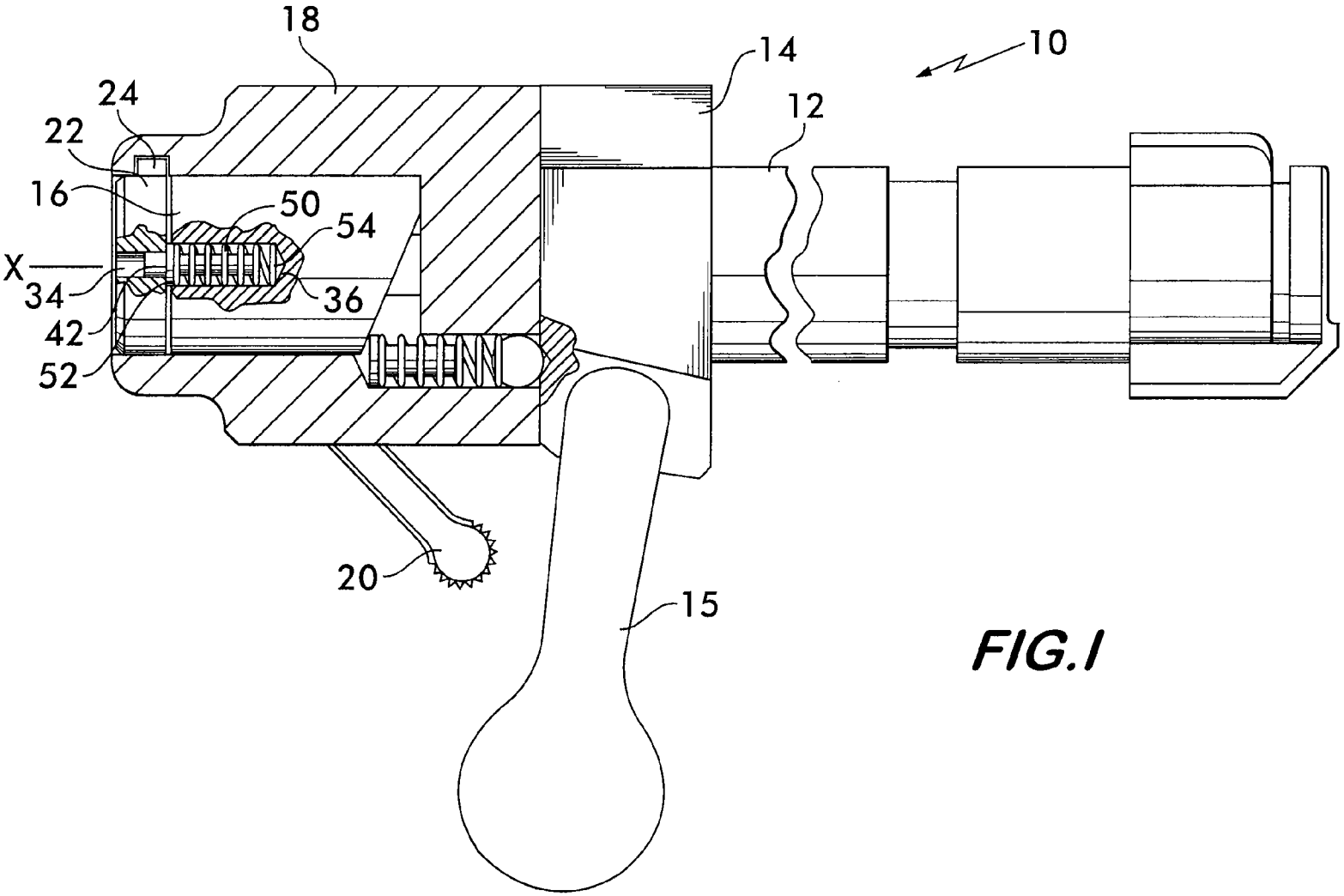
FIG. 1 is a partial, top, partial cross-sectional view of a bolt, cocking piece, and cocking piece housing of a firearm having an integral lock in accordance with a first preferred embodiment of the present invention.

Referring now to the drawings, wherein like part numbers refer to like elements throughout the several views, there is shown in FIG. 1 an integral locking device for a rifle 10 in accordance with one preferred embodiment of the present invention.

The present invention is generally directed to bolt-action rifles, such as the Winchester Bolt Model 70. The general design of the primary components of the Winchester Model 70 are used with modification to several of the elements to provide for the benefits of the present invention. The rifle 10 generally includes a stock assembly, a magazine and associated hardware and a trigger and associated hardware. These elements are not shown in the drawing figures, but are very well known to those skilled in the art of rifle design, as the Model 70 has been around for many decades and is considered a "classic" rifle design. As shown in FIG. 1, a preferred embodiment of the rifle 10 of the present invention further includes a barrel assembly 12, a bolt 14, a cocking piece 16 having an integral firing pin, and a cocking piece housing 18. The bolt 14 is rotatable relative to the cocking piece housing 18 by lever 15, as is well known.

The safety includes a safety lever 20 that is rotatable in the cocking piece housing 18 (also known as a breech bolt sleeve). A preferred embodiment of a three position safety is shown, for example, in U.S. application Ser. No. 10/772,018, entitled Three Position Safety for a Bolt Action rifle, the complete specification of which is fully incorporated by reference. The safety is not described in detail here.

A bolt action rifle of the type described herein may be prevented from firing by locking the cocking piece 16 (having the integral firing pin) relative to the cocking piece housing 18. This is accomplished by the design of the present invention. The cocking piece 16 is shown in detail in FIGS. 10–14. The cocking piece housing 18 is shown in detail in FIGS. 8 and 9.

As can be seen most clearly in FIG. 1, the integral locking system for a firearm 10 utilizes a bolt 14 that is axially rotatable relative to the cocking piece housing 18. The locking system for the firearm 10 uses a generally circular cocking piece lock 22 (see FIGS. 6 and 7) that is disposed in a special receiving slot 24 in the cocking piece housing 18. See FIGS. 8 and 9. Since the exterior shape of the lock 22 is preferably generally circular and the receiving slot 24 is preferably generally circular, the lock 22 is rotatable within receiving slot 24.

Figure 3:
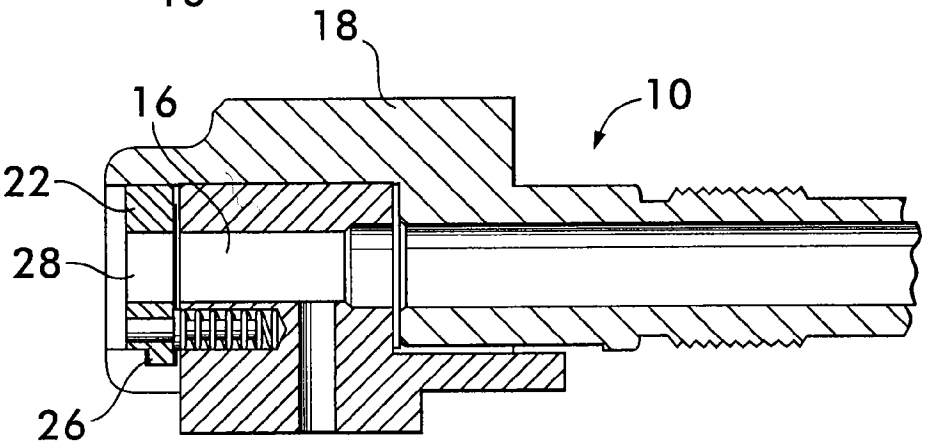
FIG. 3 is an enlarged front cross sectional view of the bolt, cocking piece and cocking piece housing of FIG. 2.
Figure 15:
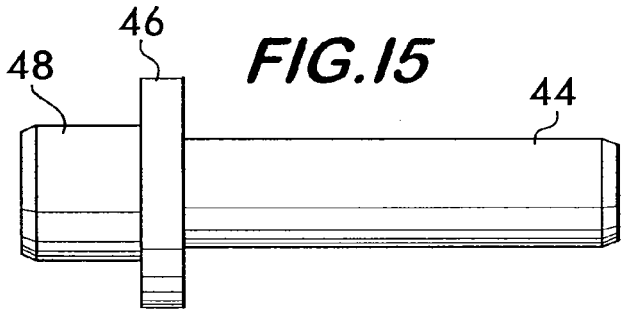
FIG. 15 is a front view of a cocking piece plunger, as used in the firearm of FIG. 1.
Figure 17:
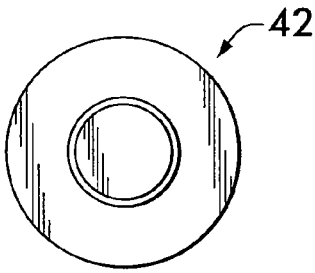
FIG. 17 is a right side view of the cocking piece plunger of FIG. 15.
Figure 16:
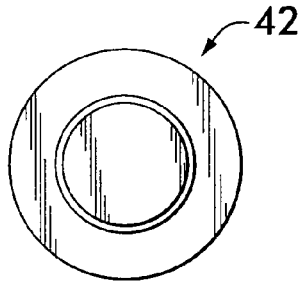
FIG. 16 is a left side view of the cocking piece plunger of FIG. 15.
Figure 18:
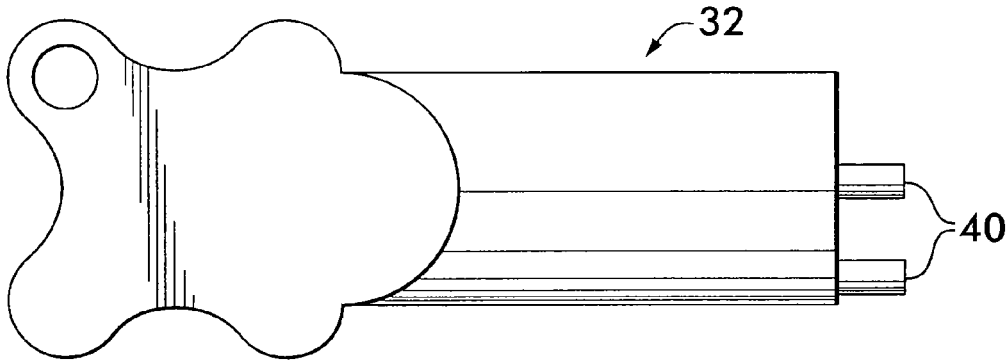
FIG. 18 is a front view of a key, as used in the firearm of FIG. 1.
Figure 19:
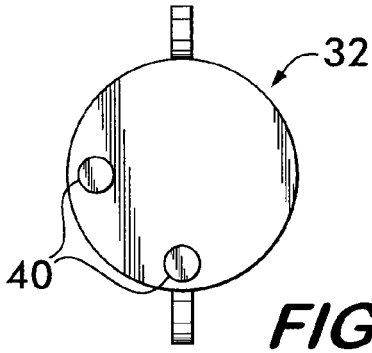
FIG. 19 is a left side view of the key of FIG. 18.

As best seen in FIGS. 3 and 4, the lock 22 also has an integral blade 26 extending from the circular body of the lock 22, a central aperture 28 and at least one aperture 30 to receive a key 32 (see FIGS. 18 and 19). The receiving slot 24 provides for rotational movement of the lock 22 about the longitudinal axis X (see FIG. 1) of the barrel assembly 12 and bolt 14, but substantially no movement along longitudinal axis X.

As best seen in FIG. 11, the cocking piece 16 has an aperture 34 positioned generally parallel to the longitudinal axis of the barrel assembly 12 at a radial distance Y from the longitudinal axis. The aperture 34 has a bottom 36 (FIG. 10). That is, the aperture 34 is preferably, a "blind hole." The cocking piece lock 16 has one or more apertures 30 therein that are positioned generally parallel to the longitudinal axis X. The apertures are adapted to receive protuberances 40 on the key 32. See FIGS. 18 and 19. A spring loaded cocking piece plunger 42 is used that has a shaft portion 44 slidably received in the aperture of the cocking piece 16. The plunger 42 has an annular flange 46 that is adjacent to the shaft portion 44 where the annular flange 46 is larger in cross-section than the shaft 44. The plunger 42 also has a head portion 48 that is smaller in cross section than the annular flange 46. The shaft 44, the head portion 48 and the annular flange 46 all have a smaller cross section than the cross section of the aperture 34 of the cocking piece 16 such that the entire plunger 42 is slidably receivable in the aperture 34 of the cocking piece 16.

A coil spring 50 is disposed on the plunger 42 to urge the plunger 42 in a direction towards the lock 22. The coil spring 50 has an internal diameter larger than the diameter of the shaft 44 of the plunger 42, but smaller than the diameter of the annular flange 46. The spring 50 has a first end 52 and a second end 54. The first end 52 abuts the annular flange 46 of plunger 42 and the second end 54 abuts the bottom 36 of the aperture 34 in the cocking piece 16.

Figure 2:
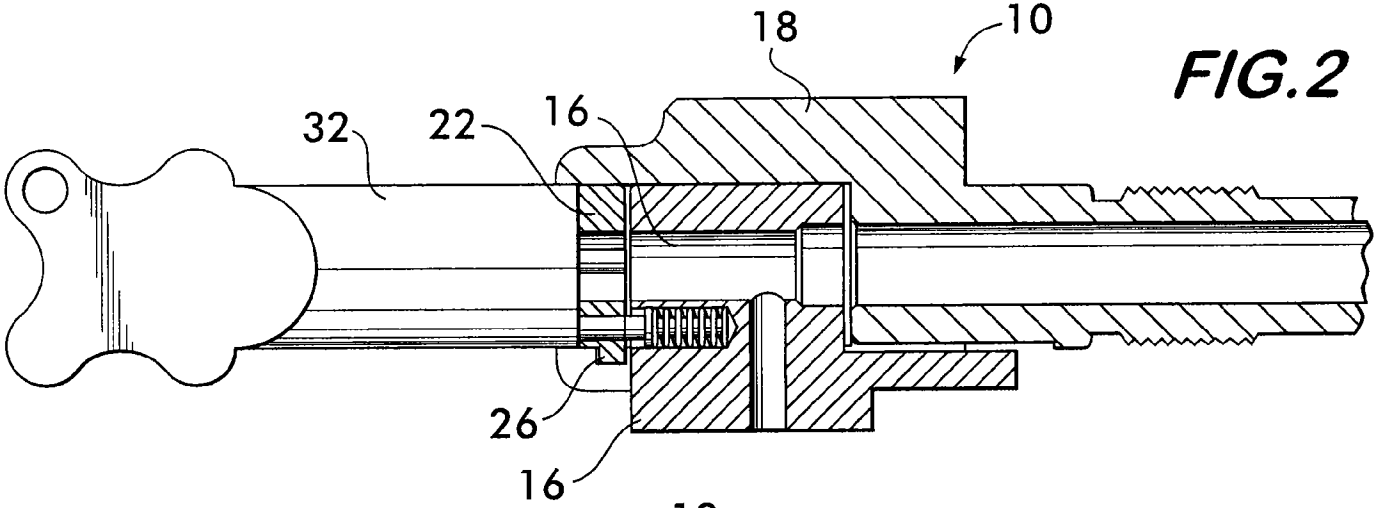
FIG. 2 is a partial front cross sectional view of the bolt, cocking piece and cocking piece housing of a firearm having the integral lock in accordance with FIG. 1, further depicting a key for the lock inserted into the lock.

The key 32 has at least one protuberance 40 adapted to be inserted into the aperture or apertures 30 in the lock 22. Each protuberance 40 has a length that is substantially the same length as the width of the lock 22 such that the protuberances 40 is flush with the lock when the key 32 is fully inserted in the lock 22. When the key 32 is inserted into the lock 22, each protuberance 40 abuts the head portion 48 of its plunger 42 to urge the head portion 48 of the plunger fully out of the lock 22 and fully into the cocking piece 16, whereby when the plunger 42 is fully inserted into the cocking piece 16, the lock 22 is free to rotate about axis X and when the plunger 42 is urged by spring 50 into one of the lock apertures 30, the lock 22 is held securely and is not free to move rotationally. Again, this is most clearly seen in comparing FIG. 1 (showing the plunger 42 locked to the lock 22) to FIG. 2 (showing the key 32 pushing the plunger 42 in to allow the lock 22 to rotate).

The cocking piece housing 18 has a slot 58 and a groove 60 (see FIG. 9) to receive the blade 26 of the lock 22 and to allow lock 26 and cocking piece 16 to move axially relative to the cocking piece housing 18. The slot 58 is located at the bottom of the cocking piece housing 18 and allows for longitudinal movement (along axis X as shown in FIG. 1) of the barrel assembly 12 when the blade 26 of the lock 22 is rotated down, using the key 32, as shown in FIG. 6. When the lock 22 is rotated ninety degrees in a clockwise direction, as shown in FIG. 4, the blade 26 of the lock 22 is captured within the groove 60 of cocking piece 16 (compare FIG. 4 to FIG. 5). Here, longitudinal movement (along axis X) is not possible. That is, the cocking piece 16 with integral firing pin may not move longitudinally relative the cocking piece housing 18 when the blade 26 is captured in the groove 60.

As noted above, the plunger 42 prevents rotational movement of the lock 22 when the plunger 42 is aligned with the aperture 34 in the cocking piece 16. At least one aperture or apertures 34 in the cocking piece 16 are located such that when the lock is rotated to a position where the blade 26 of the lock 22 is captured within the slot 58 of the cocking piece 16.

With the lock 22 in the locked position (i.e., as shown in FIG. 5), the cocking piece 16 is locked to the cocking piece housing 18, preventing the bolt from rotating and thereby preventing the action from being opened.

Although illustrated and described herein with reference to specific embodiments, the present invention nevertheless is not intended to be limited to the details shown. Rather, various modifications may be made in the details within the scope and range of equivalents of the claims without departing from the spirit of the invention.

What is claimed is:

1. An integral locking system for a firearm, the firearm having a barrel having a longitudinal axis, a bolt, a cocking piece having an integral firing pin, and a cocking piece housing, the bolt axially rotatable relative to the cocking piece housing, the integral locking system comprising:

(A) a cocking piece lock rotatably disposed in a receiving slot in the cocking piece housing, the lock having an integral blade extending from the lock and an aperture adapted to receive a key, the receiving slot adapted to allow rotational movement of the lock about the longitudinal axis, but substantially no movement along the longitudinal axis;

(B) the cocking piece lock having at least one aperture therein, the aperture positioned generally parallel to the longitudinal axis and at substantially the same radial distance as the aperture in the cocking piece;

(C) a cocking piece plunger slidably received in the aperture;

(D) the key adapted be inserted into the aperture in the lock to urge the head of the plunger fully into the cocking piece, whereby when the plunger is inserted into the aperture of the cocking piece, the lock is free to rotate relative to the cocking piece housing and when the plunger is urged into one of the lock apertures, the lock is held securely and is not free to move rotationally relative to the cocking piece housing; and (E) the cocking piece having a groove adapted to receive the blade of the lock, the groove adapted to allow the blade of the lock and cocking piece to move rotationally relative to the cocking piece housing, and stop longitudinal movement of the cocking piece when the lock is rotated to a locked position.

2. The integral locking system of claim 1, wherein the cocking piece has a slot adapted to receive the blade prior to receipt of the blade into the groove, the slot adapted to receive the blade when the cocking piece is moved forward relative to the cocking piece housing before the blade is received in the groove.

3. An integral locking system for a firearm, the firearm having a barrel having a longitudinal axis, a bolt, a cocking piece having an integral firing pin, and a cocking piece housing, the bolt axially rotatable relative to the cocking piece housing, the integral locking system comprising:

(A) a cocking piece lock, the lock rotatably disposed in a receiving slot in the cocking piece housing, the lock having an integral blade extending from the lock, and an aperture adapted to receive a key, the receiving slot adapted to allow rotational movement of the lock about the longitudinal axis, but substantially no movement along the longitudinal axis;

(B) the cocking piece having at least one aperture therein, the aperture positioned generally parallel to the longitudinal axis and at radial distance from the longitudinal axis, the aperture having a bottom;

(C) the cocking piece lock having at least one aperture therein, the aperture having a cross section and positioned generally parallel to the longitudinal axis and at substantially the same radial distance as the aperture in the cocking piece;

(D) a cocking piece plunger slidably received in the aperture;

(E) the plunger having a smaller cross section than the cross section of the aperture of the cocking piece such that the entire plunger is slidably receivable in the aperture of the cocking piece;

(F) a cocking piece spring disposed to urge the plunger in a direction towards the lock, the spring having a first end and a second end, the first end abutting the plunger and the second end abutting the bottom of the aperture in the cocking piece;

(G) the key having at least one protuberance adapted be inserted into the aperture in the lock, each protuberance having a length such that each protuberance extends through the lock, each protuberance adapted to abut the plunger to urge the head of the plunger fully into the cocking piece towards the bottom of the aperture in the cocking piece, whereby when the plunger is fully inserted into the aperture of the cocking piece, the lock is free to rotate relative to the cocking piece housing and when the plunger is urged into one of the lock apertures, the lock is held securely and is not free to move rotationally relative to the cocking piece housing;

(H) the cocking piece having a groove adapted to receive the blade of the lock, the groove adapted to allow the blade of the lock and cocking piece to move rotationally relative to the cocking piece housing, and stop longitudinal movement of the cocking piece when the lock is rotated to a locked position.

4. The integral locking system of claim 3, wherein the cocking piece has a slot adapted to receive the blade prior to receipt of the blade into the groove, the slot adapted to receive the blade when the cocking piece is moved forward relative to the cocking piece housing before the blade is received in the groove.

5. An integral locking system for a firearm, the firearm having a barrel having a longitudinal axis, a bolt, a cocking piece having an integral firing pin, and a cocking piece housing, the bolt axially rotatable relative to the cocking piece housing, the integral locking system comprising:

(A) a generally circular cocking piece lock, the lock rotatably disposed in a receiving slot in the cocking piece housing, the lock having an integral blade extending from the lock, a central aperture and at least one aperture adapted to receive a key, the slot adapted to allow rotational movement of the lock about the longitudinal axis, but substantially no movement along the longitudinal axis;

(B) the cocking piece having at least one aperture therein, the aperture having a cross section and positioned generally parallel to the longitudinal axis and at radial distance from the longitudinal axis, the aperture having a bottom;

(C) the cocking piece lock having at least one aperture therein, the aperture positioned generally parallel to the longitudinal axis and at substantially the same radial distance as the aperture in the cocking piece;

(D) a cocking piece plunger having a shaft portion slidably received in the aperture of the cocking piece, an annular flange adjacent to the shaft portion, the annular flange being larger in cross-section than the shaft, and a head portion, the head portion being smaller in cross section than the annular flange;

(E) the shaft portion, the head portion, and the annular flange all having a smaller cross section than the cross section of the aperture of the cocking piece such that the entire plunger is slidably receivable in the aperture of the cocking piece;

(F) a cocking piece coil spring disposed on the plunger to urge the plunger in a direction towards the lock, the coil spring having an internal diameter larger than the shaft of the plunger, but smaller than the annular flange, the spring having a first end and a second end, the first end abutting the annular flange and the second end abutting the bottom of the aperture in the cocking piece;

(G) a key having at least one protuberance adapted be inserted into the at least one aperture in the lock, each protuberance having a length such that each protuberance extends through the lock, each protuberance adapted to abut the head portion of the plunger to urge the head of the plunger fully into the cocking piece towards the bottom of the aperture in the cocking piece, whereby when the plunger is fully inserted into the cocking piece, the lock is free to rotate relative to the cocking piece housing and when the plunger is urged into one of the lock apertures, the lock is held securely and is not free to move rotationally relative to the cocking piece housing;

(H) the cocking piece having a slot and a groove adapted to receive the blade of the lock, the slot adapted to receive the blade when the cocking piece is moved forward relative to the cocking piece housing, the groove adapted to receive the blade of the lock after the blade is moved forward into the slot, the groove adapted to allow the blade of the lock and cocking piece to move rotationally relative to the cocking piece housing, and stop longitudinal movement of the cocking piece when the lock is rotated to a locked position.

* * * * *